US006070449A

United States Patent [19]

Vachon

[11] Patent Number: 6,070,449

[45] Date of Patent: Jun. 6, 2000

[54] CRIMPING TOOL

[76] Inventor: Michel Vachon, 2395 1ére Avenue Sartigan, Saint-Georges-de-Beauce, Québec, Canada, G5Y 5B8

[21] Appl. No.: 09/299,605

[22] Filed: Apr. 27, 1999

[51] Int. Cl.[7] ..... B21J 9/18; B21D 9/08

[52] U.S. Cl. ..... 72/451; 72/409.12

[58] Field of Search ..... 72/451, 409.01, 72/409.12

[56] References Cited

U.S. PATENT DOCUMENTS

| | | | |
|---|---|---|---|
| 1,743,209 | 1/1930 | Groehn | 72/451 |
| 4,531,397 | 7/1985 | Pratt | 72/451 |
| 4,558,584 | 12/1985 | Myers | 72/407 |
| 4,989,438 | 2/1991 | Simon | 72/325 |
| 5,381,686 | 1/1995 | Throrup | 72/453.06 |
| 5,878,617 | 3/1999 | Parker | 72/451 |

*Primary Examiner*—David Jones
*Attorney, Agent, or Firm*—Eric Fincham

[57] ABSTRACT

A hand held crimping tool which may be pneumatically or hydraulically operated and which utilizes first and second jaw members and first and second linking arms joined together such that they may move in a scissors-like movement, the pneumatic or hydraulic means operating on an actuating member which is connected to the first and second linking arms. The tool is conveniently used for crimping corrugated panels such as are used in wall and roof structures.

4 Claims, 2 Drawing Sheets

Fig. 3
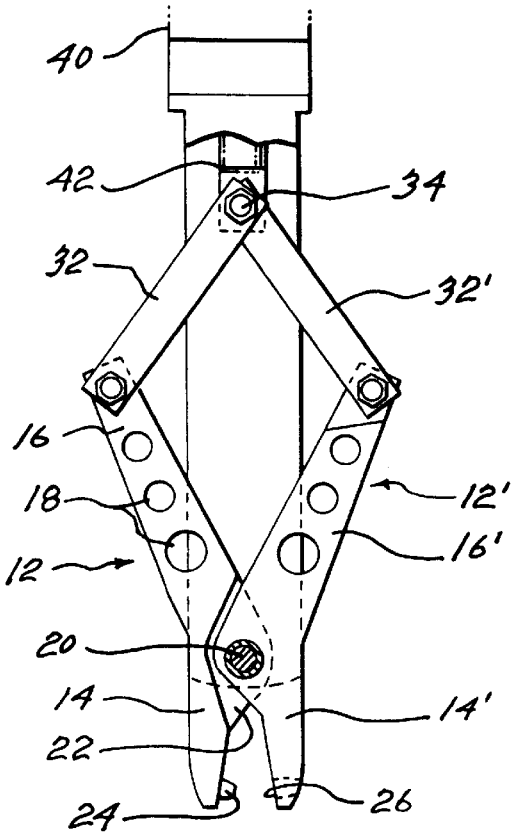
Fig. 4
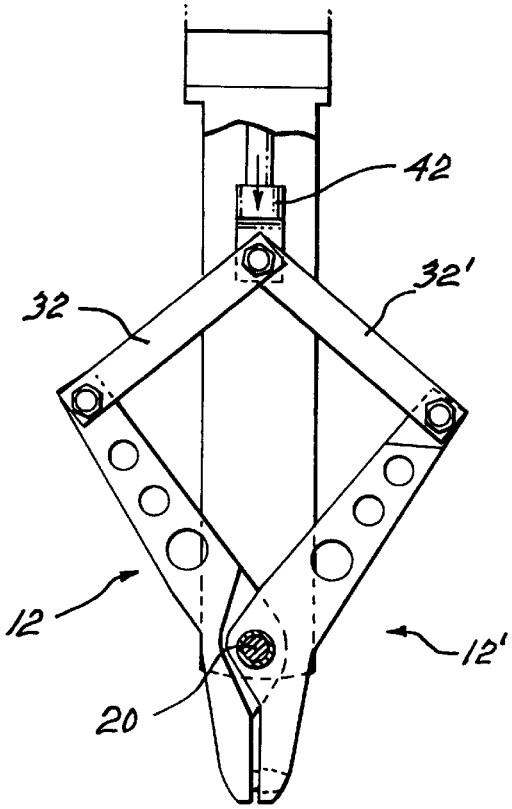
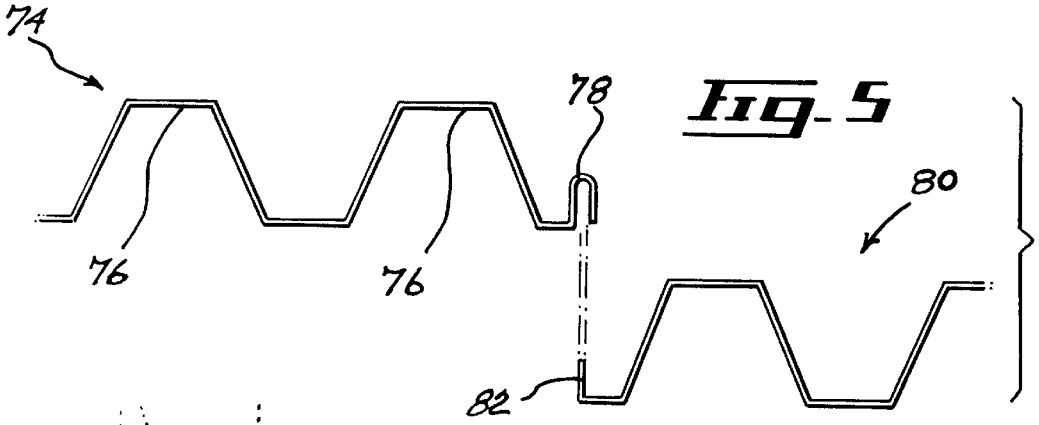
Fig. 5
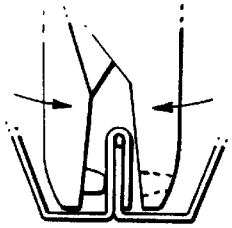
Fig. 6
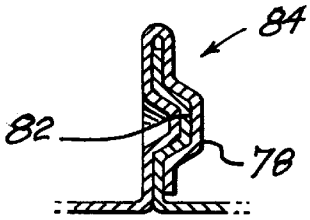
Fig. 7

CRIMPING TOOL

The present invention relates to the field of crimping tools, and more particularly is concerned with a pneumatically or hydraulically operated hand held crimping tool.

BACKGROUND OF THE INVENTION

Crimping tools and well known in the art and many different crimping tools have been designed for various applications. In this respect, they tend to be application specific.

Sheets of metallic material are often used in a variety of construction situations. For example, they are used both as siding and also receive extensive use as roofing material. The sheets of metallic material are typically in a corrugated form in order to add the required strength to the material.

The metallic sheets are manufactured in a predetermined size and must be assembled at the construction site. As aforementioned, the sheets usually are of a corrugated configuration and have peripheral edges which are designed to fit together in a mating relationship. As such, the mating edges are often assembled by a crimping action using a manual crimping tool.

While various hand held crimping tools are known in the art, they are usually manually operated and as such, are not suitable for larger construction jobs. Accordingly, there exists a need for an improved crimping tool which is suitable for joining corrugated metallic sheets together.

SUMMARY OF THE INVENTION

It is an object of the present invention to provide a crimping tool which allows for quick assembly of panels positioned in an edge to edge relationship relative to each other.

It is a further object of the present invention to provide a crimping tool which may be used in a safe and economic fashion to reduce the risk of injury.

It is a further object of the present invention to provide a hand held crimping tool which may be pneumatically or hydraulically operated and which will be economical to manufacture, long lasting and relatively trouble free in operation.

According to one aspect of the present invention, there is provided a hand held crimping tool comprising first and second jaw members; first and second linking arms; an actuating member, means for reciprocally moving the actuating member; each of the first and second jaw members having a respective first elongated portion and a second elongated portion; the first and second jaw members being pivotably connected together at a point proximate where the respective first and second elongated portions join together; a distal end of the first elongated portion of the first jaw member and a distal end of the first elongated portion of the second jaw member each having a cooperating crimping element located thereon; a distal end of the second elongated portion of the first jaw member being pivotably connected to a first end of the first linking arm; a distal end of the second elongated portion of the second jaw member being pivotably connected to a first end of the second linking arm; the second end of each of the first and second linking arms being pivotably connected together and being connected to the actuating member, the arrangement being such that movement of the actuating member will cause the first and second linking arms and the first and second jaw members to move in a scissors-like movement and to thereby cause the distal ends of the first elongated portion of each of the first and second jaw members to move together to bring the cooperative crimping elements together in a crimping action; the actuating member being operatively connected to the means for reciprocally moving the actuating member.

The crimping tool of the present invention is specifically suitable for use in assembling corrugated metal panels together such as may be encountered in the construction of metallic roofs.

The crimping tool of the present invention may be either pneumatically or hydraulically operated. The use of either hydraulic or pneumatic cylinders is well known in the art and either one may be substituted for the other.

The crimping tool of the present invention may be operated by a pair of handles operatively connected to the pneumatic or hydraulic valves and cylinders, again this is well known in the art.

BRIEF DESCRIPTION OF THE DRAWINGS

Having thus generally described the invention, reference will be made to the accompanying drawings illustrating an embodiment thereof, in which:

FIG. 3 is a side elevational view of the jaw members of the crimping tool of FIG. 1 showing the jaws in an open position;

FIG. 4 is a side elevational view similar to FIG. 3 illustrating the jaw members in a closed position;

FIG. 5 is a side elevational view of a portion of two corrugated panels to be assembled together;

FIG. 6 is a side elevational view showing the crimping of the two panels together; and FIG. 7 is a cross sectional view of the crimped portion of the panels.

DESCRIPTION OF THE PREFERRED EMBODIMENTS

Figure 1:
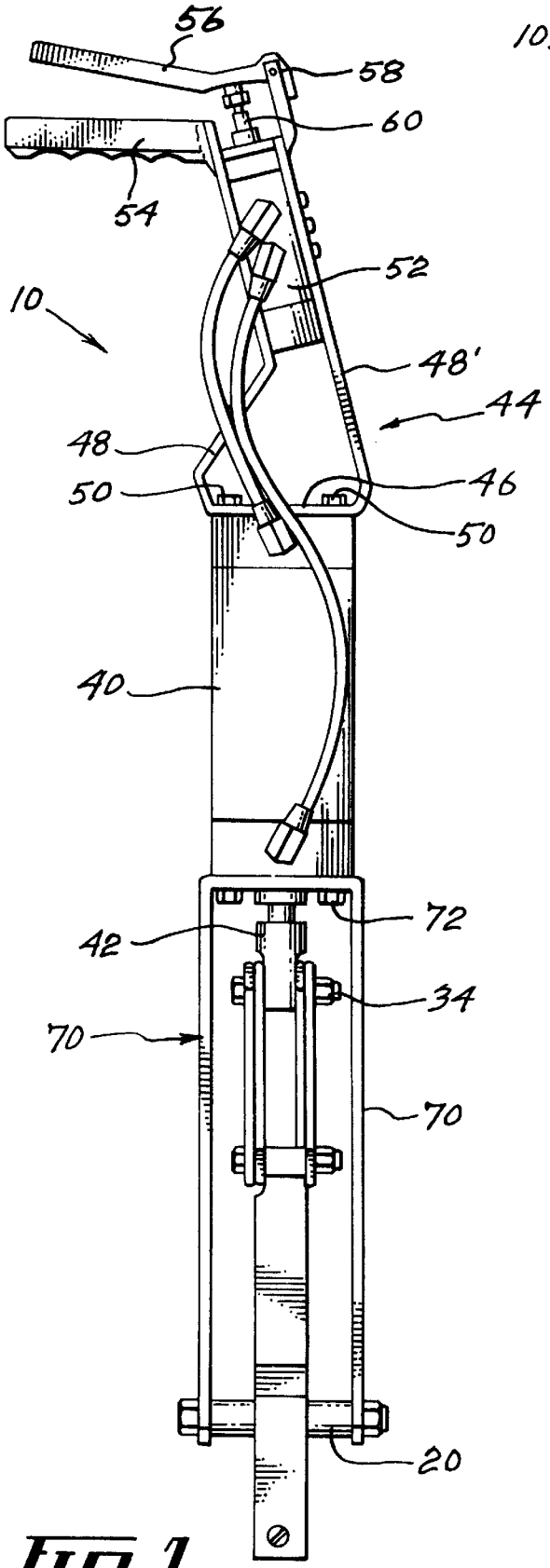
FIG. 1 is a side elevational view illustrating a crimping tool in accordance with an embodiment of the present invention.
Figure 2:
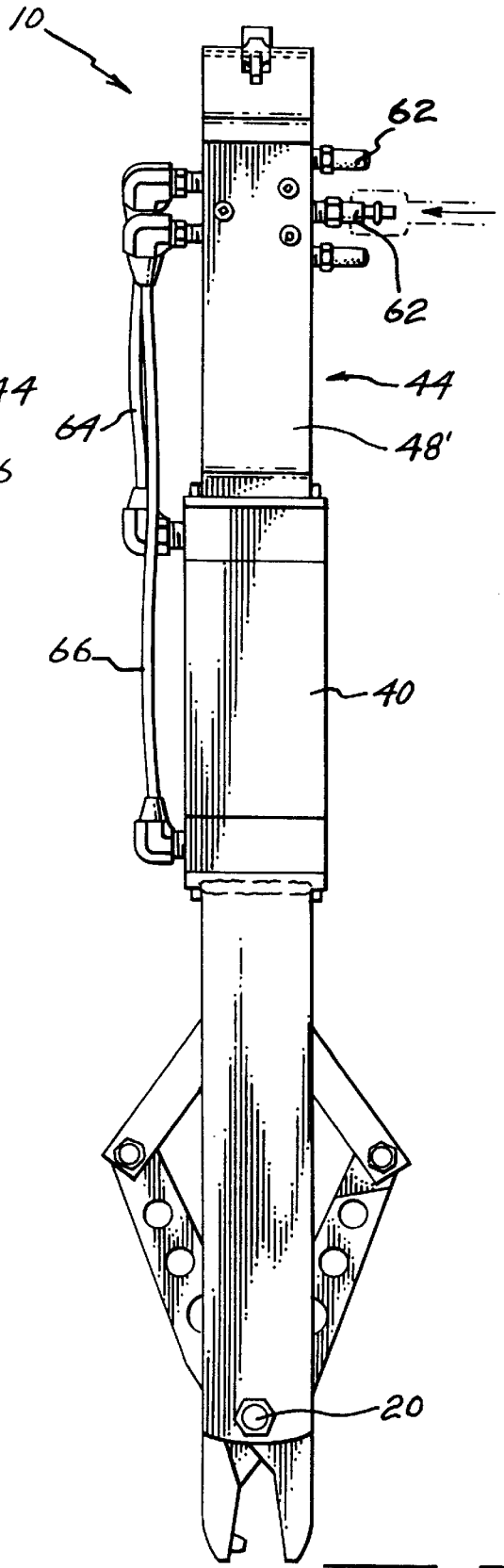
FIG. 2 is an end elevational view of the crimping tool of FIG. 1 as seen from the right hand side thereof.

Referring to the drawings in greater detail, there is illustrated in FIGS. 1 and 2 a crimping tool which is generally designated by reference numeral 10. Crimping tool 10 includes first and second jaw members 12 and 12' respectively and which jaw members 12, 12' will now be described in greater detail by reference to FIGS. 3 and.

Jaw members 12 and 12' are similar and thus only one will be described in detail with reference numerals having a prime describing identical components.

First jaw member 12 includes a first elongated portion generally designated by reference numeral 14 and a second elongated portion generally designated by reference numeral 16. Second elongated portion 16 has a plurality of apertures 18 formed therein.

Jaw members 12 and 12' are connected together by a fastener such as a rivet 20 at a point proximate the emerging or meeting of first elongated portion 14 and second elongated portion 16. To provide for interconnection of jaw members 12, 12', jaw member 12 has a top wall recess 22 formed therein while a similar recess (not precisely identical nor shown) is provided on jaw member 12'. The top wall recess 22 is provided for the mated fitting of jaw members 12, 12' in a manner known in the art.

At a distal end of first elongated portion 14, there is provided a crimping element which, in the illustrated embodiment, comprises a crimping pin 24. Second jaw member 12' has a mating crimping recess 26 at the distal end of first elongated portion 14'.

As shown in FIGS. 3 and 4, there are provided first and second linking arms 32 and 32' respectively. Linking arm 32 has a first end thereof pivotably connected by means of fastener 34 to a distal end of second elongated portion 16 of first jaw member 12. A similar arrangement is provided with respect to linking arm 32' which has a first end thereof connected to a distal end of second elongated portion 16' of jaw member 12'.

At their respective second ends, linking arms 32, 32' are connected by means of a fastener 34 to each other and to a piston arm 42 of a cylinder 40.

Cylinder 40 may be either a conventional hydraulic or pneumatic cylinder designed to move piston arm 42 in a conventional manner as will be described hereinbelow.

Attached to the upper portion of cylinder 40 is a first frame generally designated by reference numeral 44 and which has a base 46 connected to the top of cylinder 40 by means of fasteners 50. Extending upwardly from the base are a pair of side walls 48, 48'. As may be seen in FIG. 1, a U-shaped frame 70 is provided about the jaw members and linking arms and also functions for mounting cylinder 40 by means of fasteners 72.

Mounted between side walls 48, 48' is a valve 52 for reasons explained hereinbelow.

Attached to side wall 48 is a fixed handle 54 while a movable handle 56 is connected at pivot point 58 to side wall 48'.

Extending downwardly from movable handle 56 is a valve actuating member 60.

The crimping tool is provided with a connector 62 for connecting to a suitable supply of air or fluid which are required for actuation of valve 52 and cylinder 40. As is known in the art, a first hose 64 extends from valve 52 to an upper portion of cylinder 40 while a second hose connects between valve 52 and the lower portion of cylinder 40. The arrangement is such that a closing of the handles 54 and 56 will cause valve actuating member 60 to activate piston arm 42 which will move in a downward direction as illustrated in FIG. 4. This movement in turn will cause a scissors-like movement of linking arms 32, 32' and jaw members 12, 12' to thereby cause a crimping action by crimping pin 24 and crimping recess 26. Release of the handle will then cause the reverse movement to happen to return to the open position shown in FIG. 3.

The crimping tool may conveniently be used for crimping together corrugated panels in a manner illustrated in FIGS. 5, 6 and 7. As shown in FIG. 5, there is a first corrugated panel 74 having corrugations 76 therein and which is provided with a U-shaped channel 78 at one end. A second corrugated panel 80 is designed to mate with first corrugated panel 74 by means of an upwardly extending flange 82 which fits within U-shaped channel 78.

As shown in FIG. 6, the crimping tool is then placed in position and upon actuation, there is a movement of the jaws together to provide a crimp 84 as shown in FIG. 7.

It will be understood that the above described embodiment is for purposes of illustration only and that changes and modifications may be made thereto without departing from the spirit and scope of the invention.

I claim:

1. A hand held crimping tool consisting essentially of an upper frame assembly, a lower frame assembly and an actuating cylinder selected from the group consisting of a hydraulic cylinder and pneumatic cylinder, said lower frame assembly including;

first and second jaw members;

first and second linking arms;

said actuating cylinder having an actuating piston, means for reciprocally moving said actuating piston;

each of said first and second jaw members having a respective first elongated portion and a second elongated portion;

said first and second jaw members being pivotably connected together at a point proximate where said respective first and second elongated portions join together;

a distal end of said first elongated portion of said first jaw member and a distal end of said first elongated portion of said second jaw member each having a cooperating crimping element located thereon;

a distal end of said second elongated portion of said first jaw member being pivotably connected to a first end of said first linking arm;

a distal end of said second elongated portion of said second jaw member being pivotably connected to a first end of said second linking arm;

said second end of each of said first and second linking arms being pivotably connected together and being connected to said actuating piston, the arrangement being such that movement of said actuating piston will cause said first and second linking arms and said first and second jaw members to move in a scissors-like movement and to thereby cause said distal ends of said fist elongated portion of each of said first and second jaw members to move together to bring said cooperative crimping elements together in a crimping action;

said upper frame assembly including an inverted U-shaped frame having first and second arms and a base, said base of said U-shaped frame being secured to a top of said actuating cylinder;

an actuating valve assembly mounted between said first and second arms, said actuating valve being operatively connected to said actuating cylinder to reciprocably move said actuating piston; and a moveable handle mounted at a distal end of said first arm, said moveable handle being operative to open and close said actuating valve.

2. The crimping tool of claim 1 wherein said means for reciprocally moving said actuating member comprises a hydraulic cylinder.

3. The crimping tool of claim 1 wherein said means for reciprocally moving said actuating member comprises a pneumatic cylinder.

4. The crimping tool of claim 1 wherein said cooperative crimping elements comprise a crimping pin extending outwardly from one of said jaw members and a crimping recess on the other of said jaw members.

* * * * *